United States Patent [19]

Schmidt

[11] 3,980,242

[45] Sept. 14, 1976

[54] COIL WINDING MACHINE FOR TOROIDAL CORES EMPLOYING CORE HOLDER ASSEMBLY

[75] Inventor: Hans Schmidt, Deerfield, Ill.

[73] Assignee: Quasar Electronics Corporation, Franklin Park, Ill.

[22] Filed: Apr. 29, 1974

[21] Appl. No.: 465,017

Related U.S. Application Data

[63] Continuation of Ser. No. 364,563, May 29, 1973, abandoned, which is a continuation of Ser. No. 144,140, May 17, 1971, abandoned.

[52] U.S. Cl. ..... 242/4 C

[51] Int. Cl.[2] ..... H01F 41/08

[58] Field of Search ..... 242/4 C, 4 R, 4 A, 4 B, 242/4 BC

[56] References Cited

UNITED STATES PATENTS

| | | | |
|---|---|---|---|
| 2,868,466 | 1/1959 | Hammer | 242/4 A |
| 3,030,038 | 4/1962 | Baker et al. | 242/4 A |
| 3,559,899 | 2/1971 | Fahrbach | 242/4 B |
| 3,601,731 | 8/1971 | Christiana | 242/4 R UX |

FOREIGN PATENTS OR APPLICATIONS

| | | | |
|---|---|---|---|
| 165,872 | 1/1959 | Sweden | 242/4 R |

*Primary Examiner*—Billy S. Taylor

*Attorney, Agent, or Firm*—Drummond, Nelson & Ptak

[57] ABSTRACT

An annular core holder form supports in rotatable fashion a toroidal core in connection with a pair of fixed support members to comprise a core holder assembly for winding wire coils on the core through the action of a revolving wire-carrying shuttle of a coil winding machine. The core holder form is intergally wound to the core through the wrapping action of the shuttle and is removable with the core. The pair of support members and the holder form have generally central first openings extending axially therethrough to permit the shuttle to thread the core, support members and holder form in order to wind the wire coils axially about the annular wall of the core. The support members have respective second openings communicating with the first openings and which are aligned with each other to permit the passage of a winding wire strand. The core holder form has two axially spaced rows of outer tooth-like projections, either or both of which can be used to rotatingly drive the holder form and toroidal core as a unit. Precision and closely wound coils of wire are continuously wrapped about successive arcuate segments of the annular walls of the holder form and core as they are exposed through the second openings to the shuttle operation. The two rows of projections of the holder form are used to restrain the axial loops of each coil of wire for securing the same against lateral movement along the ends of the core and for maintaining the alignment of the axial loops in substantially perpendicular traversement of the ends of the core.

4 Claims, 10 Drawing Figures

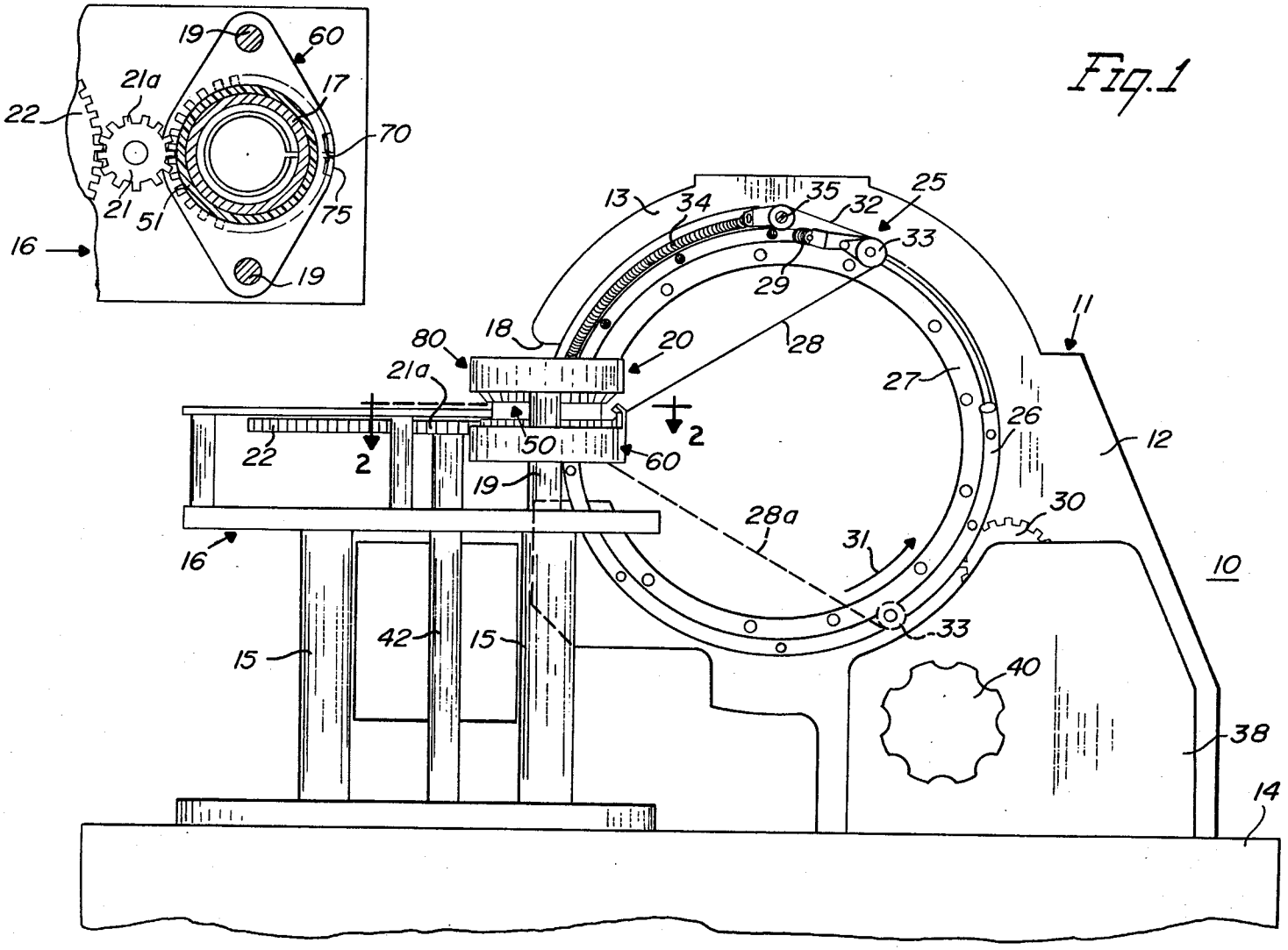
INVENTOR:
HANS SCHMIDT
BY: Lester N Arnold
ATTY.

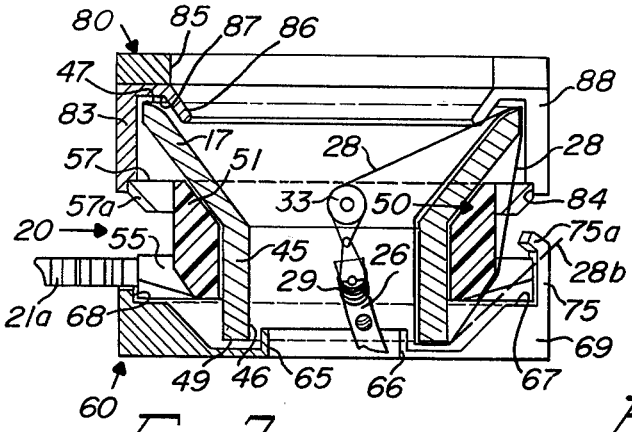
Fig. 3
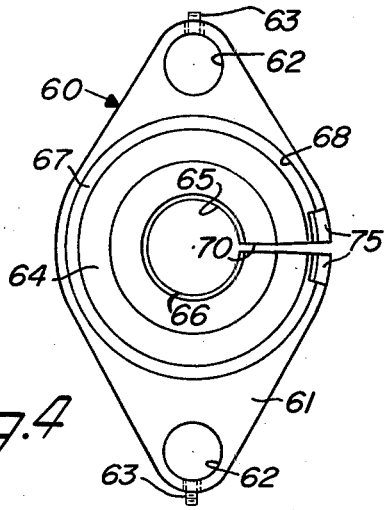
Fig. 4
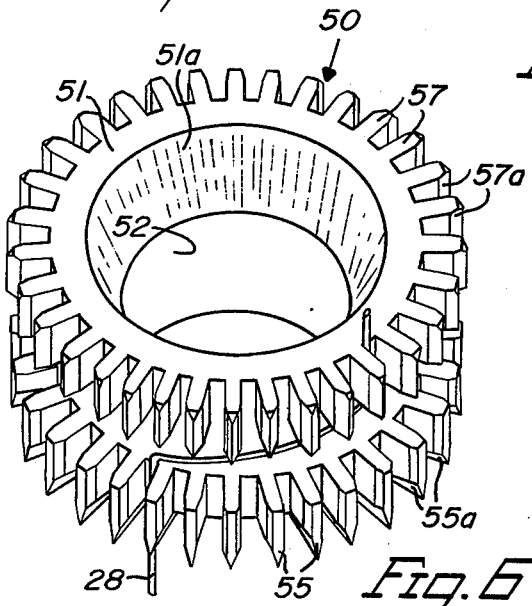
Fig. 6
Fig. 7
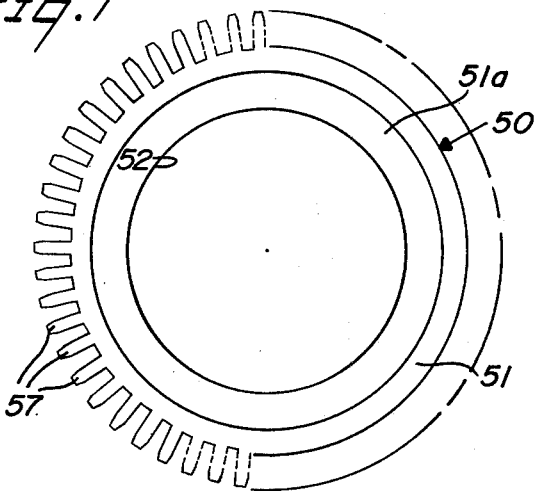
Fig. 10
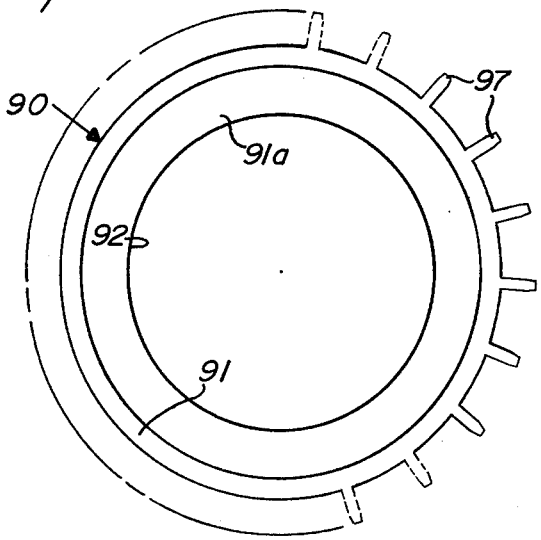
Fig. 5
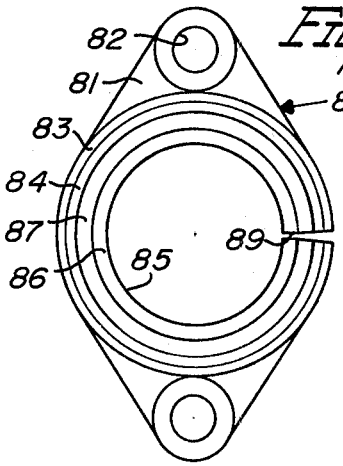
INVENTOR:
HANS SCHMIDT
BY: Lester N Arnold
ATTY.

INVENTOR:
HANS SCHMIDT
BY: Lester N. Arnold
ATTY.

COIL WINDING MACHINE FOR TOROIDAL CORES EMPLOYING CORE HOLDER ASSEMBLY

This is a continuation of application Ser. No. 364,563, filed May 29, 1973, now abandoned which is a continuation of application Ser. No. 144,140, filed May 17, 1971, now abandoned.

BACKGROUND

This invention relates generally to coil winding machines for winding toroidal cores, and more particularly, to an improved core holder assembly adapted to provide continuous and accurate winding of precision wound toroidal cores.

Coil winding machines of the type useful for practicing the present invention utilize a revolving or circulating wirecarrying shuttle for winding a wire strand continuously about an exposed arcuate segment of the annular wall of a closed toroidal core, the core being supported in a manner to permit rotation of the core about a central axis thereof to selectively expose other arcuate segments for being wound to form the number of coils of wire comprising the windings of a toroidal core. The difficulties involved in existing machines and their ancillary support apparatus relate to providing suitable support members which do not interfere with the winding of the wire strand about the annular wall or with the passage of the shuttle through the central opening of the toroidal core; providing for the capability to rotate the core through a full circle without remounting the core with respect to the support apparatus due to mechanical interference between this apparatus and the shuttle; providing a uniform driving mechanism for rotating the core so that the accurate spacing of the axial loops of wire of each individual coil such as would be required for precision winding can be accomplished; and providing for securing these axial loops against misalignment or lateral movement along opposite rim portions of the toroidal core that could cause field distortion for the current-carrying coils.

One existing type of support structure for the toroidal core is a clamp which engages at least aligned portions of the opposite rims or ends of the core for leaving the remaining rim or end portions free; however, the core must be repositioned within the clamp for full circular utilization of these rim portions. Another winding technique is to rotate the core on fixed supports to continuously expose a free segment of the core to the circulating shuttle and its wire strand. This technique requires an interface with the core that will not vary in rotating speed with subsequent build-up of layers of coil such as is inherent in using revolving wheels that frictionally engage the annular wall.

In some core support or holder assemblies, the core is completely encased within a core holder form that is constructed of a material like plastic which will not appreciably interfere with the magnetic field characteristics of the core. Some core holder forms are provided with outwardly-extending radial ribs which can then be grasped by rotating drive mechanism to turn the core with respect to its support structure. Also, the core holder forms are provided with opposite rim portions covering the rim portions of the core for providing radial grooves therein in which to deposit the axial loops of wire thereby to prevent misalignment or lateral displacement. These radial grooves must be aligned properly between opposite rim portions, and the rotating mechanism must be correlated so that the circulating wire strand is deposited therein. It is desirable to provide a core holder form which allows the wire strand to be deposited directly across the rim portions of the core to form the axial loops while simultaneously preventing coil deformation caused by movement of the wire along these rim portions.

SUMMARY

It is, therefore, an object of the present invention to provide a rotatable core holder form and a pair of fixed support members to comprise a core holder assembly for supporting a toroidal core in a manner so as to permit continuous and uniform rotation of the core without the need to reposition the core with respect to the holder assembly.

It is another object of the invention to provide the alignment of a central axial dimension of the core in a vertical direction so that the rotating core can simply be supported against gravitational force.

It is still another object to provide for the continuous circulation of a wire strand for winding about the annular wall of the core without interference between the wire strand and the support structure.

It is yet another object to provide a core holder form for surroundingly engaging the core and which can be used to impart rotational movement to the core.

A further object is to provide a core holder form which exposes the opposite rim or end portions of the core for directly depositing there across the axially extending wire loops of each of a number of coils, while generally securing the axial loops against misalignment on, or lateral movement along, the respective rim portions.

A still further object is to provide a method for winding the toroidal core having such a core holder form in accordance with the foregoing objects.

A coil winding machine has a revolving shuttle for carrying a wire strand from a wire supply spool in a continuous winding fashion for winding the wire about selectively exposed arcuate segments of the annular wall of a vertically supported and rotating closed toroidal core. The toroidal core is to be wound with a number of wire coils circumferentially spaced from each other along the annular wall according to a selected winding pattern and each having a number of axial loops of wire deposited along successive lateral portions of the core. The core is supported by a bottom support member which permits relatively free rotation of the core and which contains openings to permit the passage of the shuttle and wire strand, respectively. A core holder form is provided to encompass the intermediate portion of the core for exposing opposite rim portions of the core, the axial wire loops being directly supported across the rim portions in substantially perpendicular traversement thereof. Guide members on the support member cooperate with an associated opening of the support member to retain the wire strand therein as the core is rotated subsequent to winding a first coil of wire and prior to winding a second coil of wire on a newly aligned segment of the annular wall. The holder form provides projections for restraining the leading and trailing axial loops of each coil of wire for securing the axial loops against lateral movement along the rim portions and for maintaining the alignment of said loops of wire in substantially perpendicular traversement thereof.

DRAWING

FIG. 1 is a side elevational view of a coil winding machine showing a core holder assembly supporting a toroidal core for being wound by a wire-carrying shuttle of the winding machine in accordance with the present invention;

FIG. 2 is a sectional view generally taken along the line 2—2 of FIG. 1;

FIG. 3 is an elevational cross-sectional view of the core holder assembly of FIG. 1;

FIG. 4 is a top plan view of the bottom support member of the core holder assembly of FIG. 1;

FIG. 5 is a bottom plan view of the top support member of the core holder assembly of FIG. 1;

FIG. 6 is a perspective view of the core holder form of the core holder assembly of FIG. 1;

FIG. 7 is a top plan view of the core holder form of FIG. 6;

FIG. 10 is a top plan view of an alternative core holder form useful with the coil winding machine of FIG. 8.

DETAILED DESCRIPTION

Figure 8:
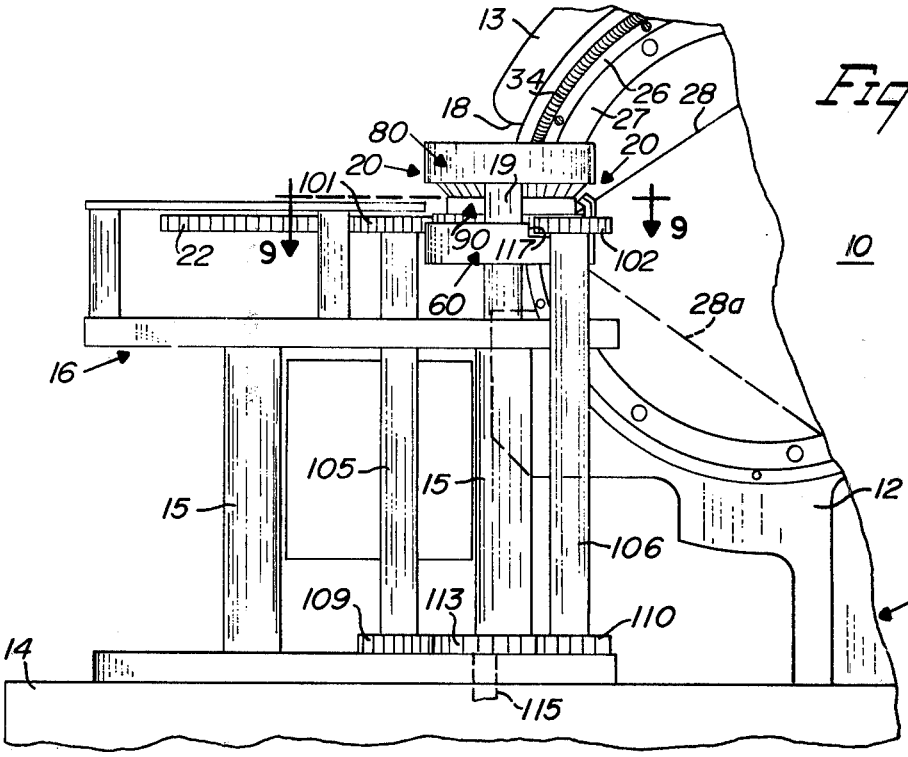
FIG. 8 is a side elevational view of an alternative coil winding machine similar in many respects to the coil winding machine of FIG. 1.

Referring to the drawing, FIG. 1 shows a coil winding machine 10 for winding toroidal cores useful in a variety of applications including use as deflection yokes for television picture tubes. A housing enclosure 11 for the coil winding machine 10 has an upper housing portion 12 including a C-frame 13 and a lower housing portion 14. Extending above the lower housing portion 14 on support post 15 is a raised support structure 16 for positioning a toroidal core 17, FIGS. 2 and 3, within an opening 18 of the C-frame 13.

The toroidal core 17 is a vertically supported against gravitational force by and housed for rotation within a core holder assembly 20. Rotational drive for the core 17 is supplied by a drive gear 21 having outer gear teeth 21*a* which mesh with a core holder form comprising part of the holder assembly 20. These outer gear teeth also mesh with the teeth of an indicator wheel 22, the upper surface of which is convenient for mounting thereon any one of a number of winding patterns for the toroidal core 17 for serving as a visual reference for operators of the winding machine 10.

The C-frame includes a revolving wire-carrying shuttle 25 comprising an arcuate tubular carriage 26 mounted for movement on a shuttle race or track 27 for carrying a wire strand 28 continuously in a revolving circular pattern through the toroidal core 17. The shuttle 25 carries the wire strand 28 from a suitable wire supply or feed spool such as an elongated wire coil or spool 29 housed within one end of the tubular carriage 26. The shuttle 25 revolves counterclockwise (CCW) about the shuttle race 27, as indicated by an arrow 31 and the dashed wire strand 28*a*, the carriage 26 being propelled by a gear drive means within the upper housing portion 12 including gear wheel 30 which meshes with a complementary drive track (not shown) connected to the carriage 26.

The wire strand 28 is continuously pulled from the wire spool 29 over a first pulley 33 that travels with the carriage 26. The wire is held taut for providing tightly wound loops or wraps of wire about the core 17 by being looped around, at 32, a second pulley 35 connected to a spring biasing coil 34 in a configuration quite common for coil winding machines wherein it is convenient to orient the shuttle 25 to circumscribe a circular path ordinarily aligned in a vertical plane. The gear drive means within the upper housing portion 12 comprises a part of the internal operating mechanism of the winding machine 10 with which to operate the shuttle 25, and includes additional gears hidden from view in FIG. 1 by a cover plate 38. A handle or knob 40 is conveniently provided for manually turning the additional gears including gear wheel 30 so that the shuttle carriage 26 may be positioned about the race 27 without automatic operation of the winding machine 10.

The lower housing portion 14 of the winding machine 10 comprises a housing for another part of the internal operating mechanisms of the machine 10, the other part comprising a means for operating the drive gear 21 in a corresponding relation to the operation of the shuttle 25. In particular, the drive gear 21 can be driven by a revolving shaft extending through a casing 42 and connected to suitable driving means within the lower housing portion 14. For precision winding of the toroidal core, the rotation of the core 17 must be closely correlated with each full revolution of the shuttle carriage 26 so that the placement of the wire strand 28 about the core and the spacing between consecutively wound loops of wire are precisely controlled. The internal operating mechanisms within the upper and lower housing portions 12 and 14 are interconnected in such a manner that the core 17 is rotated a fractional portion of a complete revolution with each full revolution of the shuttle carriage 26 to provide for core rotation in definite incremental steps.

The closed toroidal core 17, on which the winding is to be placed as shown in FIG. 3, has an annular wall 45 substantially in the shape of a inverted cone. The annular wall 45 defines a central opening 46 extending therethrough in an axial direction of the core. The ends of the core 17 comprise a pair of axially opposite rim or edge portions 47 and 49 of the wall 45, rim portions 47 and 49 comprising top and bottom rim portions, respectively, with the core 17 vertically supported by the core holder assembly 20. Core 17 rotates about its central axial dimension to define a rotational axis which comprises a vertical rotational axis when aligned in the vertical direction within the vertical plane of the shuttle 25.

Closed toroidal cores of the type to be used with the coil winding machine 10 have common configurations including hollow cylindrical tubes, sections of inverted cones with elongated axial lengths, and the traverse sectional views thereof are generally annular. Such cores are made of a material of low permeability to enhance the electromagnetic field distribution patterns resulting from current-carrying coils wound thereon. The concentration of these fields is known to be more critical near the ends of the cores and less critical in the intermediate portions of the cores with coil placements extending axially along the lengths of the cores and substantially perpendicular across the rim portions thereof. Hence, it is important to provide for securing the wire across these rims against lateral movement therealong and for maintaining the substantially perpendicular traversement of the wire thereacross.

Coil formations for the toroidal cores are greatly varied in their number and spacing but a number of coils are usually provided on a single core with an individual coil including a number of axial loops of wire occupying successive lateral portions of the annular wall in closely wound fashion. Consecutively wound coils are separated along the annular wall by various spacings required by a selected winding pattern, and multiple layers of these coils are often wound on the core. Difficulties encountered, therefore, in obtaining precision wound cores in addition to providing core support and winding access to the annular walls during continuous and uniform rotation of the cores, relate to maintaining the originally placed positions of the wire with respect to the cores.

According to the present invention, the core holder assembly 20 includes the core holder form 50 and first and second support members 60 and 80 acting as bottom and top support members, respectively. The support members 60 and 80 are mounted on a pair of support posts 19 which comprise a part of the raised support structure 16. The bottom support support member 60 is slidably mounted on the post 19 for lowering the member 60 from its assembled position to permit the toroidal core 17 and the holder form 50 to be inserted and removed from the holder assembly 20.

The opening 18 of the C-frame 13 is suitably elongated to accommodate the movement of the member 60 without having to remove the holder assembly 20 from its proper alignment within the path of travel of the shuttle 25. Other assembly mounting configurations could as well be utilized whereby the holder assembly 20 or at least the support member 60 could be removed from the aligned position within the opening 18, one such alternative being to pivot the entire holder assembly 20 clear of the C-frame 13 for thereby removing the toroidal core 17 and the holder form 50.

The core holder form 50 of the assembly 20 comprises a holder for the toroidal core 17. Accordingly, the holder form 50 has an annular configuration, such as a ring-like band, to be used to circumferentially surround the core 17 with the core inserted through a central opening 52 defined by an annular wall 51. As will be later described, the axial loops of wire are wound about the annular walls 45 and 51 to fixedly mount the holder form 50 to the toroidal core 17. The core 17 and holder form 50 then function as a unit in providing for core rotation during coil winding and thereafter, in the removal of the toroidal core for its ultimate use. The form 50 preferably is made of a non-magnetizable material such as plastic.

The central opening 52 of the holder form 50 preferably conforms to the particular shape of the core 17 for providing a snug reception of the core within the holder form 50. FIG. 3 shows the core 17 to be generally funnel-shaped similar to a section of an inverted cone with the diameter of the bottom rim portion 49 being less than the diameter of the top rim portion 47. Thus, the annular wall 51 of the holder form 50 is provided with an outwardly diverging beveled portion 51*a* to receive the widened section of the annular wall 45 of the core 17. The relationships of the diameters of the rim portions 47 and 49 could optionally be reversed, the configuration of FIG. 3 being intended only to illustrate a single embodiment of the holder form and toroidal core. It is apparent that many other core configurations could be complementarily accommodated by suitable holder forms.

Since it is intended that the rim portion 47 and 49 be exposed for directly supporting the axial loops of wire substantially perpendicular thereacross, the axial length of dimension of the holder form 50 should be made equal to or less than that of the toroidal core. Preferably, the axial length thereof should be somewhat less than the axial length or dimension of the core so that a maximum amount of direct association can be obtained between the wire coils and the core material in the critical end areas of the core.

The holder form 50 of the instant embodiment encompasses only the intermediate section of the core 17, and has a thickness such that the outer periphery of the annular wall 51 does not protrude radially outward beyond the outer periphery of the larger rim portion, the top rim portion 47, of the core 17. The configuration of the holder form 50 is, of course, less critical in the intermediate portion of the core for reasons previously stated relating to the electromagnetic field distribution patterns; nevertheless, it is easier to provide operation within the core holder assembly 20 if the form 50 is generally conformed to the geometry of the core 17.

The outer periphery of the annular wall 51 is provided with first and second continuous rows of tooth-like projections or fins 55 and 57, respectively, which rows are axially spaced and have their respective projections in axial alignment for receiving the winding wire strand 28 between aligned pairs of projections in the two rows 55 and 57. The edge portions of the projections for the rows 55 and 57 can be slightly inclined as indicated in FIGS. 3 and 7 at 55*a* and 57*a*, respectively, to guide the wire strand 28 to either side thereof when the strand strikes these projections. The two rows of projections 55 and 57 comprise bottom and top rows, respectively, with the toroidal core being vertically supported. The order of the rows is conveniently determined from bottom to top due to the direction of winding, namely, across the bottom rim portion 49, between the bottom and top rows 55 and 57 and then across the top rim portion 47.

The bottom support member 60 is shown in FIGS. 3 and 4 in its assembled and isolated positions, respectively. The bottom member 60 comprises a relatively shallow cup-like container for supporting the combined core 17 and holder form 50, and may also be made of non-magnetizable material. The member 60 is generally annular in its configuration except for opposite enlarged shoulder portions 61, FIG. 4, that each contain an opening 62 within which to slidably receive the support posts 19. A pair of adjustable set screws 63 may be provided in communication with the pair of openings 62 to permit tightening for securing the member 60 to the posts 19. The member 60 has an inner wall surface 64 and an inner flange portion 66 defining a central opening 65 that is axially aligned with the central opening 46 of the toroidal core 17 for permitting the passage of the shuttle carriage 26 through the toroidal core 17 and the member 60.

FIG. 3 shows the diameter of the opening 65 to be less than the diameter of the opening 46 at the smaller diameter rim portion 49, thus permitting the flange 66 to be aligned for possible telescopic reception within the opening 46. It should be noted, however, that this configuration is not essential since the bottom rim portion 49 of the core 17 does not rest upon the inner surface 64 of the member 60. Instead, the inner surface 64 is provided with a flat shoulder or ledge portion 67 extending around the opening 65 for supportingly receiving the bottom outer edge portions of the bottom row of projections 55 of the holder form 50. A side wall 68 communicates with the ledge portion 67 in a substantially perpendicular fashion to provide lateral stability to the rotating core 17. The intermediate portion of the inner wall surface 64 lying between the ledge portion 67 and the inner flange 66 is then shaped to provide adequate clearance for the bottom rim portion 49 and its deposited wire coils.

The member 60 is discontinuous in its generally annular configuration along a plane bisecting a plane passing through the pair of openings 62, and has a pair of opposing wall faces 69 defining a channel-like opening 70. The opening 70 communicates with the central opening 65 of the member 60 for permitting the passage of the wire strand 28 entirely through the bottom member in a non-interfering fashion. In the assembled position of the member 60, the bisecting plane is aligned with the vertical plane of travel of the shuttle 25 so that the opening 70 presents an exposed arcuate segment of the annular wall 45 of the core 17 and an accompanying segment of the annular wall 51 of the holder form 50.

As the shuttle carriage 26 wraps the wire strand about the exposed segments of the annular walls 45 and 51 in the manner previously described, the core 17 and holder form 50 are rotated along the ledge portion 67 by the drive gear 21 which engages generally the top outer edge portion of the bottom projections 55. The operation of the drive gear 21 causes adjacent segments of the annular walls 45 and 51 to move into alignment within the channel-like opening 70 whereby axial loops of wire are continuously wound about successive lateral portions of the annular walls 45 and 51 to form closely wound coils thereon.

Adjacent the outermost portion of the channel 70 and having an inner wall face comprising an extension of the wall faces 69, the bottom member 60 includes a pair of guide members 75. The guide members 75 extend above the inner wall surface 64 and ledge portion 67 to provide for retaining the wire strand 28 within the channel 70 during a coil spacing procedure characterized by a continued rotation of the core 70 with simultaneous discontinued rotation of the shuttle 25. Each of the guide members 75 includes an inwardly turned upper portion 75*a* to further assure good contact with the wire strand 28 during the above-described coil spacing procedure.

FIG. 5 shows an isolated bottom view of the top support member 80 which is ideally constructed of non-magnetizable material and is similar in its configuration to the bottom support member 60. The top support member 80 is optionally included with the assembly 20 to provide additional stability to the combined rotational movement of the core 17 and holder form 50. As shown in FIGS. 3 and 5, the member 80 comprises a cup-like container of generally annular configuration except for opposite enlarged shoulder portions 81 having openings 82 therethrough, respectively, for permitting the member 80 to be mounted on the support post 19 of the winding machine 10.

The member 80 includes an annular side wall 83 having an L-shaped recess 84 along the inside of its outer edge portion, the recess 84 receiving guidingly the top outer edge portions of the respective projections of the top row of projections 57. The member 80 defines a central opening 85 which is axially aligned with the central openings 46 and 65 for accommodating the operation of the shuttle 25. An inner flange portion 86 shaped for a slight telescopic reception within the opening 46 of the core 17 defines together with the side wall 83 an annular recess 87 therebetween. In the holder assembly 20, the member 80 is supported upon posts 19 so that the rotating rim portion 47 of the core 17 is loosely received therein to permit adequate clearance for the deposited coils of wire.

The member 80 also has a pair of opposing wall faces 88 defining a channel-like opening 89 communicating with the central opening 85 of the member 80. The channel opening 89 permits the passage of the wire strand 28 entirely through the top support member in a non-interfering fashion with the opening 89 aligned with the channel opening 70 of the bottom support member 60.

As previously described, the drive gear 21 rotates the holder form 50 and its inserted core 17 by incremental steps to align successive lateral portions of the exposed arcuate segments of the annular walls 45 and 51, to the continuously winding wire strand 28, thereby to provide axially extending precision and closely wound coils of wire thereon. In order to space the coils along the annular walls of the core 17 and holder form 50, the shuttle 28 has a predetermined position, as shown in FIG. 1, in which the carriage 26 remains stationary while the core 17 and holder form 50 continue to be rotated.

The wire strand 28, as indicated by the dashed line 28*b* in FIG. 3, is engaged by an adjacent projection 55 and restrained thereby for movement with the core 17 and holder form 50. As shown in FIG. 6, the guide members 75 retain the feeding wire strand 28 therebetween so that the wire is wrapped over the top edge of the engaging projection 55 and extends circumferentially about the annular wall 51 of the holder form 50 between the engaging projection 55 and the guide members 75. The engaging projection 55 secures the trailing axial loop of a previously or first wound coil against lateral movement along the bottom rim portion 49 of the core 17 and maintains the alignment of the trailing axial loop in substantially perpendicular traversement of the rim portion 49.

Upon obtaining the appropriate spacing between the first wound coil and a subsequent or second wound coil, the operation of the shuttle 25 is then continued to thereby deposit the wire strand 28 between an aligned pair of projections in the top row of projections 57, FIG. 6. This latter depositing of wire comprises a leading axial loop for the second wound coil. Continued shuttle operation completes the winding of the second coil in the manner previously described. The leading axial loop of the second wound coil is secured against lateral movement along the top rim portion 47 of the core 17 by an adjacent engaging projection 57 and is maintained in substantially perpendicular traversement of the rim portion 47.

FIG. 6 shows a fragmentary portion of the wire strand 28 being deposited on the holder form 50 to illustrate the pattern of lateral securement of the wire strand 28 during the coil spacing operation. The wire strand 28 is firstly engaged by a bottom projection 55 that is the next-to-be-exposed projection in the channel opening 70, secondly engaged by a top projection 57 that is the previously-exposed projection in the channel opening 70 and extends generally diagonally between the pair of engaging projections.

It is to be noted that without the restraint of the engaging projections 55 and 57 upon the wire strand 28 during the coil spacing procedure, the wire would extend generally diagonally between the rim portions 47 and 49. Stresses along the taut wire strand 28 would tend to shift the trailing and leading axial loops toward each other along the respective rim portions of the core 17. The effect is to provide a general loosening in the lateral tightness of the closely wound coils of wire whereby further lateral shifting of the interior axial loops of wire can occur for each of the coils. Also, a subsequent depositing of a second layer of wire coils upon these loosened first layer of coils, will result in further lateral shifts and misalignment of the substantially perpendicular traversement of the axial loops across the rim portions 47 and 49.

Figure 9:
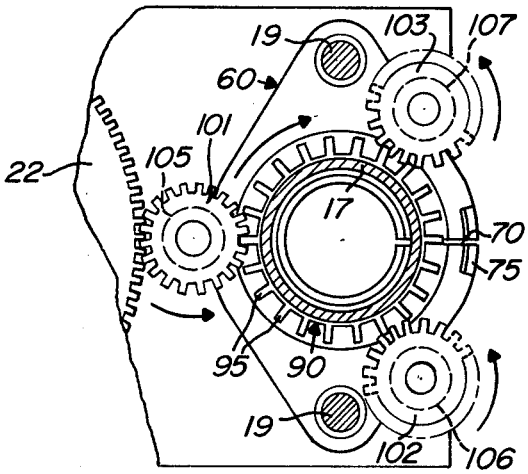
FIG. 9 is a sectional view generally taken along the line 9—9 of FIG. 8.

FIGS. 8–10 show an alternative drive gear arrangement to be employed with a modified core holder form 90 useful within the core holder assembly 20 and wherein similar parts are identified by the same reference numerals. For progressively smaller toroidal core sizes, the drive gear arrangement of the principal embodiment requires closer spacing of the projections in the two rows of projections 55 and 57 on the holder form 50 in order to mesh with the teeth of the drive gear 21. A point is reached, however, where close spacing between these projections becomes a disadvantage due to wire congestion and alignment difficulties.

The core holder form 90 is identical to the holder form 50 except that every third projection of the two rows of projections is retained and the other projections are omitted for providing more space between adjacent teeth. Briefly, the holder form 90 includes an annular wall 91 having a beveled portion 91*a* and defining a central opening 92. Two rows of outer tooth-like projections 95, FIG. 9, and 97, FIG. 10, comprise bottom and top rows, respectively, for the holder form 90, the bottom row 95 being exposed within the assembly 20 for engagement with three drive gears 101–103 of the coil winding machine 10. The three drive gears are required so that one of the projections 95 will at all times be meshed with and driven by one of the drive gears thereby to provide a uniform rotational drive for the combined core 17 and holder form 90.

FIGS. 8 and 9 show the drive gears 101–103 equally spaced around the circumference of the holder form 90 and being driven in a counterclockwise (CCW) direction for driving the combined holder form 90 and core 17 in a clockwise (CW) direction. The drive gears 101–103 are driven by drive shafts (not shown) extending downwardly through casings 105-107, respectively, and are linked with auxiliary gears 109-111, respectively, (gear 111 not shown). These auxiliary gears 109-111 are driven by a main gear 113 powered through shaft 115 by the internal operating mechanism of the lower housing portion 14 of the winding machine 10. Further, if clearance of the bottom row of projections above the support member 60 is inadequate, suitable portions of the walls of the bottom support member 60 can be recessed, as indicated at 117 in FIG. 8, whereby the projections are more fully exposed to the drive gears.

While the present invention has been shown and described with reference to the preferred embodiments thereof, the invention is not limited to the precise forms set forth herein, and various modifications and changes may be made without departing from the spirit and scope thereof.

I claim:

1. The toroidal core assembly for use in a coil winding machine, comprising in combination:

a toroidal core device; and a core holder with first and second rows of aligned outer tooth-like projections axially spaced from one another and having a ring-like band adapted to circumferentially surround at least an intermediate portion of the axial dimension of said core device, said core holder further having an axial dimension less than the axial dimension of said toroidal core device for exposing the rim portions of said core device.

2. In a coil winding machine:

first means, including a wire-carrying shuttle, for continuously circulating a wire strand within a continuous vertical plane;

a toroidal core having an annular wall with opposite rim portions and forming a central opening through which said shuttle passes;

a toroidal core holder for receiving said toroidal core, said core holder having an axial dimension less than the axial dimension of said core whereby said core rim portions remain exposed, said core holder further including first and second rows of outer tooth-like projections axially spaced from one another but aligned to permit passage of axial loops of wire between associated pairs of said projections and secure the same against lateral movement; and second means cooperating with said first means in a pre-determined relation for rotating simultaneously said core and said core holder in successive incremental steps during circulation of said shuttle; and means for stopping said shuttle in a preselected position subsequent to winding a first coil about said core and core holder and prior to winding a second wire coil while said second means continues to rotate said core and core holder in said incremental steps thereby to space said first and second wire coils from one another.

3. The coil winding machine of claim 2 wherein additional means are included to insure said circulating wire strand passes between one pair of projections in said first row of projections and retained therebetween during continued rotation of said core and core holder, and guide means for aligning said strand for passage between another pair of projections in said second row of projections and retaining the same during the subsequent circulation of said strand, said other pair of projections being axially removed from alignment with said one pair of projections, and both pair thereof generally securing said wire strands against lateral movement along the associated rim portions thereof.

4. The coil winding machine of claim 3 wherein said rim portions comprise a bottom rim and a top rim, said first and second rows of projections being associated with said bottom and top rims, respectfully.

* * * * *